US008083492B2

(12) United States Patent
Kern

(10) Patent No.: US 8,083,492 B2
(45) Date of Patent: Dec. 27, 2011

(54) WELDED LOW-PRESSURE TURBINE SHAFT

(75) Inventor: Torsten-Ulf Kern, Wesel (DE)

(73) Assignee: Siemens Aktiengesellschaft, Munich (DE)

( * ) Notice: Subject to any disclaimer, the term of this patent is extended or adjusted under 35 U.S.C. 154(b) by 613 days.

(21) Appl. No.: 12/227,468

(22) PCT Filed: Feb. 23, 2007

(86) PCT No.: PCT/EP2007/051743

§ 371 (c)(1),
(2), (4) Date: Nov. 18, 2008

(87) PCT Pub. No.: WO2007/137884

PCT Pub. Date: Dec. 6, 2007

(65) Prior Publication Data

US 2009/0263249 A1 Oct. 22, 2009

(30) Foreign Application Priority Data

May 26, 2006 (EP) ..... 06010925

(51) Int. Cl.
*F01D 5/02* (2006.01)

(52) U.S. Cl. ..... 416/244 A; 464/902; 416/213 R; 415/216.1

(58) Field of Classification Search ..... 415/216.1; 464/902; 416/244 R, 244 A, 213 R, 213 A
See application file for complete search history.

(56) References Cited

U.S. PATENT DOCUMENTS

2002/0081197 A1 6/2002 Crawmer

FOREIGN PATENT DOCUMENTS

| | | | |
|---|---|---|---|
| DE | 2906371 | A1 | 8/1980 |
| EP | 1577494 | A1 | 9/2005 |
| GB | 1448063 | A | 9/1976 |
| WO | WO 2004051056 | A1 | 6/2004 |
| WO | WO 2004101209 | A1 | 11/2004 |
| WO | WO 2006048401 | A1 | 5/2006 |

*Primary Examiner* — Benjamin Sandvik
*Assistant Examiner* — Krista Soderholm

(57) ABSTRACT

Turbo-engine which has a low-pressure area, containing at least one shaft, wherein the low-pressure area has an inflow area, the shaft having, at least on its inflow part arranged in the inflow area, a heat resistant material, wherein the shaft has, on outflow parts arranged opposite the inflow part, a 26NiCrV14-5 and/or 2SNiCrMoVii-5 and/or 22CrNiM09-9 material.

8 Claims, 1 Drawing Sheet

WELDED LOW-PRESSURE TURBINE SHAFT

CROSS REFERENCE TO RELATED APPLICATIONS

This application is the US National Stage of International Application No. PCT/EP2007/051743, filed Feb. 23, 2007 and claims the benefit thereof. The International Application claims the benefits of European application No. 06010925.3, filed May 26, 2006, both of the applications are incorporated by reference herein in their entirety.

FIELD OF THE INVENTION

The invention relates to a turbomachine which comprises a low-pressure area, having at least one shaft, wherein the low-pressure area comprises an inflow area.

BACKGROUND OF THE INVENTION

A turbomachine of this type is embodied, for example, as a steam turbine. Turbomachines of this type have an inflow area and adjoining flow areas or outflow areas, with the flow areas having a blade cascade formed by rotor blades and guide vanes.

If a blade cascade of this type is arranged respectively to the left and right of the inflow area, as seen in the axial direction, so-called double-flow turbomachines are formed, with a flow medium, for example steam, flowing via the inflow area into the flow areas arranged respectively to the left and right thereof, as seen in the axial direction or in the longitudinal direction.

In the flow areas arranged respectively to the left and right of the inflow area, as seen in the axial direction, the flow medium flows in the opposite direction in relation to the respective other flow area.

In the case of double-flow turbomachines, for example, it is known to form the shaft from the material 26NiCrMoV14-5. A principal drawback of this known material is considered to be the fact that the temperature at which it is used must be restricted to T<350° C. for reasons of embrittlement and creep behavior.

In order to be able to improve the efficiency of the turbomachine, particularly the low-pressure part or the shaft in the low-pressure area has been discussed theoretically to the effect that a material improved in this respect could be used. This theoretically discussed material is 26NiCrMoV14-5mod (Superclean). Although the tendency to become brittle is reduced in the case of this material, the problem of the microstructure-dependent creep behavior is not improved. The use of the discussed modified material is possible in theory but the material costs rise by more than approximately 25 percent and there are no evaluated data regarding the creep behavior Rp0.2>600 Mpa.

SUMMARY OF THE INVENTION

The invention is therefore based on the object of improving a turbomachine of the type mentioned at the beginning, in particular the at least one shaft in the low-pressure area of the turbomachine, using simple means to the effect that said turbomachine can be exposed to higher temperatures and higher temperatures of use.

According to the invention, the object is achieved in that the shaft comprises a heat-resistant material, at least on its inflow part arranged in the inflow area. Provision is made for the inflow part to comprise the material 22CrMoNiWV8-8, with the outflow parts each being able to comprise one of the following exemplary materials: 26NiCrMoV14-5, 26NiCrMoV11-5 and/or 22CrNiMo9-9.

The inflow part preferably comprises a material of the 1-2.5% Cr steels, in particular a material with the designation 22CrNiMoWV8-8 (material number 1.6945).

It is favorable within the context of the invention if the shaft comprises a material which is tough at low temperatures on outflow parts arranged opposite the inflow part, preferably a material of the 2-4% Ni steels, in particular a 26NiCrMoV14-5 material (material number 1.6957). It is of course also possible, for example, for the respective outflow part to comprise a 26NiCrMoV11-5 material (material number 1.6948) and/or a 22NiCrMo9-9 material.

It is expedient within the context of the invention if the shaft is of a multi-part form, comprising an inflow part and an outflow part assigned to the latter on each of both sides. The inflow part in this case is integrally connected to the respective further outflow parts by means of its oppositely arranged ends. A welded connection may preferably be used as the integral connection. It is conceivable in this case for a protective gas welding process, in particular TIG welding, to be carried out as the welding process. It is also possible to carry out TIG narrow-gap welding. However, it is also possible to carry out submerged arc welding. It is of course also possible to carry out combined welding processes, with the "root layer" being provided, for example, using the TIG process and the "filling or covering layers" being provided using the submerged arc welding process.

The inflow part is arranged in the area of the steam inflow of the turbomachine, with the outflow parts each being arranged laterally with respect to the turbomachine in the longitudinal direction thereof, that is to say in the outflow area. In the area of the steam inflow, that is to say at the inflow part, the highest temperatures prevail on the shaft or on the inflow part thereof.

Overall, higher inflow temperatures (T>350° C.) can be realized using the material 22CrMoNiWV8-8 for the inflow area of the low-pressure part of the shaft, that is to say of the inflow part.

The inflow part made from the material 22CrMoNiWV8-8 may in this case advantageously be produced as a disk element with a diameter of up to 3000 mm, wherein no ESR (electroslag remelting) process is required for the disk element even in the case of the largest shaft diameters, since sufficiently homogeneous properties can be achieved even using conventional melting processes. The disk element is machined appropriately in order to fulfill its function in terms of the flow cross section.

Since the inflow part can easily be produced as a disk element and the specific ESR process (which is required for monobloc shafts of the same diameter) can be dispensed with, the number of suppliers from which the inflow part can be obtained also advantageously increases as a result of the relinquishment of requisite production standards and tolerances or specific demands placed on the suppliers.

The inflow part advantageously fulfills the necessarily high long-term strength and toughness requirement in turbomachines, in particular in the inflow area, owing to the novel material and the use of the material 22CrMoNiWV8-8 according to the invention.

It is already known to weld the two different materials, that is to say the material of the inflow part to the material of the two opposite outflow parts, with it being possible, of course, to arrange the resultant weld seams preferably in the area at a temperature T<350° C.

BRIEF DESCRIPTION OF THE DRAWINGS

Further advantageous refinements of the invention are disclosed in the dependent claims and in the following description of the figures, in which:

DETAILED DESCRIPTION OF THE INVENTION

Figure 1:
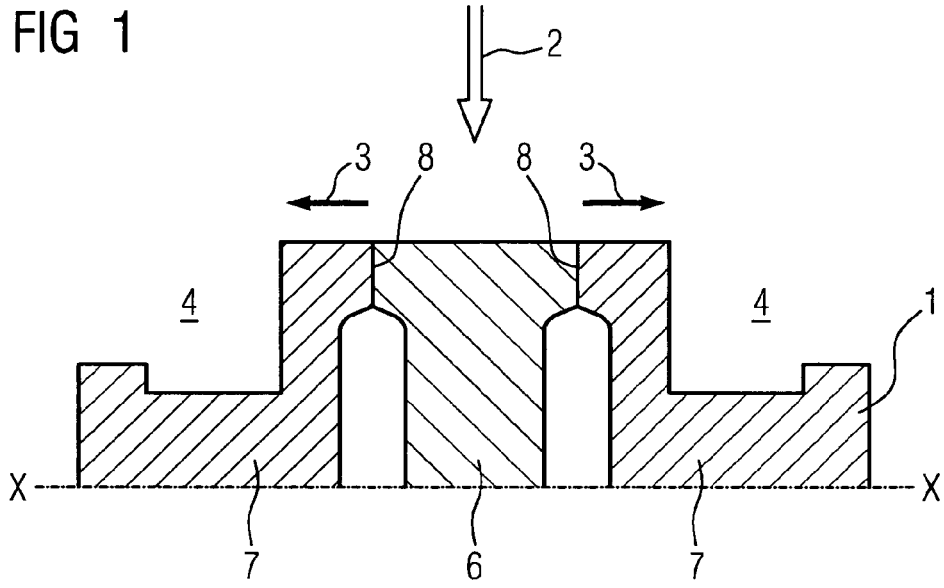
FIG. 1 shows a shaft of a low-pressure area of a turbomachine in a half cross section.

FIG. 1 shows a shaft 1 of a turbomachine in a half cross section up to a mid-axis X. The shaft 1 is of course designed to be mirror-inverted with respect to the mid-axis X. The shaft 1 is a component part of a double-flow low-pressure area. The turbomachine may be, for example, a steam turbine. The medium-pressure areas or high-pressure areas of the turbomachine possibly connected upstream are not shown.

The turbomachine has an inflow area which is shown by means of the arrow 2. Steam, for example, flows as the medium into the low-pressure area of the turbomachine, with the flow of medium being split in two flow directions 3 with respect to the approximately centrally arranged inflow area 2. Each partial flow 3 flows through a blade cascade (not shown). The low-pressure area of the turbomachine therefore has one inflow area 2 and two flow areas or outflow areas 4 arranged laterally with respect to said inflow area, as seen in the longitudinal direction or in the axial direction.

The shaft 1 is of a multi-part form, comprising an inflow part 6 and two outflow parts 7 each arranged laterally with respect to said inflow part, as seen in the longitudinal direction. The inflow part 6 is integrally connected to the respectively laterally arranged outflow parts 7. The integral connection may be in the form of a welded connection. The TIG process, preferably in the form of TIG narrow-gap welding, may be provided as the welding process. Submerged are welding may of course also be provided. The respective weld seam is denoted by the reference sign 8.

The inflow part 6 is produced as a disk element which comprises the material 22CrNiMoWV8-8. The material 22CrNiMoWV8-8 comprises 0.20-0.24% by weight C; <=0.10% by weight Si; 0.60-0.80% by weight Mn; <=0.01% by weight P; <=0.007% by weight S; 2.00-2.20% by weight Cr; 0.80-0.90% by weight Mo; 0.70-0.80% by weight Ni; 0.25-0.35% by weight V and 0.60-0.70% by weight W.

The outflow parts 7 may each be produced from one of the following materials:

26NiCrMoV14-5: This material comprises 0.22-0.32% by weight C; <=0.15% by weight Si; 0.15-0.40% by weight Mn; <=0.010% by weight P; <=0.007% by weight S; 1.20-1.80% by weight Cr; 0.25-0.45% by weight Mo; 3.40-4.00% by weight Ni and 0.05-0.15% by weight V.

26NiCrMoV11-5: This material comprises 0.22-0.32% by weight C; <=0.15% by weight Si; 0.15-0.40% by weight Mn; <=0.010% by weight P; <=0.007% by weight S; 1.20-1.80% by weight Cr; 0.25-0.45% by weight Mo; 2.40-3.10% by weight Ni and 0.05-0.15% by weight V.

22CrNiMo9-9: This material comprises 0.22-0.25% by weight C; <=0.15% by weight Si; 0.15-0.40% by weight Mn; <=0.010% by weight P; <=0.007% by weight S; 2.00-2.60% by weight Cr; 0.50-0.90% by weight Mo; 2.00-2.50% by weight Ni and 0.05-0.15% by weight V.

Figure 2:
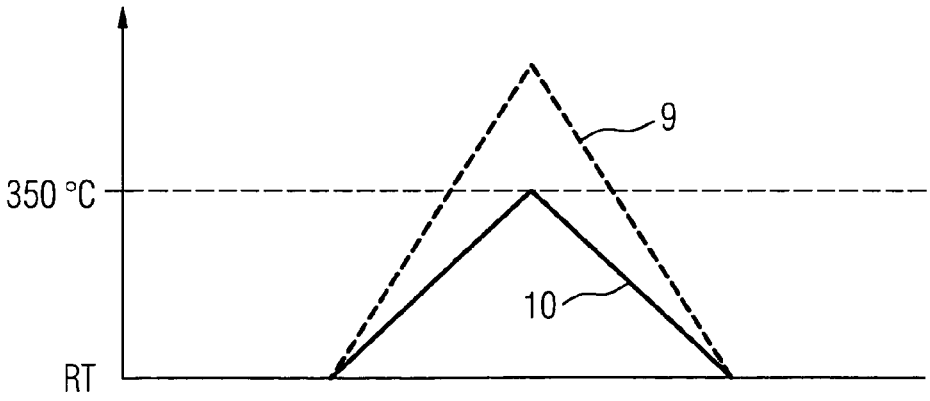
FIG. 2 shows a temperature graph.

FIG. 2 shows a temperature graph in the longitudinal direction of the shaft 1. The shaft 1 in the inflow area 2 of the turbomachine can be operated above a temperature >350° C. by means of the material 22CrNiMoWV8-8 of the inflow part 6 used according to the invention. The temperature decreases in both outflow areas 4, as seen in the longitudinal direction. Dashed lines in FIG. 2 are used to illustrate the temperature curve 9 which can be achieved by means of the material 22CrNiMoWV8-8 used according to the invention, with a conventional temperature curve 10, which does not exceed 350° C., being shown below said temperature curve.

This provides an improved shaft 1 which can be exposed to relatively high temperature loads (>350° C.) in the inflow area owing to the material 22CrNiMoWV8-8 of the inflow part 6 used according to the invention. The weld seams 8 are in this case advantageously arranged in a temperature range <350° C.

The invention claimed is:

1. A turbomachine, comprising:

a shaft comprising:

an inflow part arranged in an inflow area and comprising a 22CrMoNiWV8-8 material, and an outflow part arranged opposite to the inflow part and comprising a 26NiCrMoV11-5 material.

2. The turbomachine as claimed in claim 1, wherein the shaft further comprises a material that is tough at low temperatures on the outflow part.

3. The turbomachine as claimed in claim 1, wherein the shaft comprises multi-parts.

4. The turbomachine as claimed in claim 1, wherein the inflow part is assigned to the outflow part on each of both sides.

5. The turbomachine as claimed in claim 4, wherein the inflow part is integrally connected to the outflow part.

6. The turbomachine as claimed in claim 1, wherein the inflow part is manufactured as a disk element.

7. The turbomachine as claimed in claim 1, wherein the inflow area is in a low-pressure area.

8. A turbomachine, comprising:

a shaft comprising:

an inflow part arranged in an inflow area and comprising a 22CrMoNiWV8-8 material, and an outflow part arranged opposite to the inflow part and comprising a 22CrNiMo9-9 material.

* * * * *